US008011941B2

(12) United States Patent
Sadick et al.

(10) Patent No.: US 8,011,941 B2
(45) Date of Patent: Sep. 6, 2011

(54) DUST-TOLERANT ELECTRICAL CONNECTOR

(75) Inventors: Shazad Sadick, Queens Village, NY (US); Jason Herman, North Bellmore, NY (US); Dustyn Roberts, New York, NY (US)

(73) Assignee: Honeybee Robotics, Ltd. NY (US)

( * ) Notice: Subject to any disclaimer, the term of this patent is extended or adjusted under 35 U.S.C. 154(b) by 0 days.

(21) Appl. No.: 12/706,521

(22) Filed: Feb. 16, 2010

(65) Prior Publication Data

US 2010/0233895 A1 Sep. 16, 2010

Related U.S. Application Data

(60) Provisional application No. 61/158,933, filed on Mar. 10, 2009.

(51) Int. Cl.
*H01R 13/52* (2006.01)

(52) U.S. Cl. ..... 439/271

(58) Field of Classification Search ..... 439/271
See application file for complete search history.

(56) References Cited

U.S. PATENT DOCUMENTS 4,411,491 A * 10/1983 Larkin et al. ..... 385/73
4,682,848 A * 7/1987 Cairns et al. ..... 385/69
5,738,535 A * 4/1998 Cairns ..... 439/138
6,464,405 B2 * 10/2002 Cairns et al. ..... 385/56
7,845,966 B2 * 12/2010 Rioufreyt et al. ..... 439/367

* cited by examiner

*Primary Examiner* — Ross Gushi
(74) *Attorney, Agent, or Firm* — Amster Rothstein & Ebenstein LLP

(57) ABSTRACT

A connector assembly includes releasably mateable plug and receptacle units. At least one socket is enclosed within the receptacle unit and is aligned with at least one permeable membrane disposed in the front end of the receptacle unit. The plug unit includes a body slidably mounted within a longitudinal bore therein. At least one pin extends from the front end of the body and is aligned with at least one permeable membrane disposed in the front end of the plug unit. The plug unit is biased toward a first, de-mate position in which the body is extended rearwardly such that the pin is enclosed with the plug unit and is slidable to a second, mate position in which the body is compressed forwardly such that the pin projects through the permeable membranes of the plug and receptacle units to electrically connect with the socket.

8 Claims, 4 Drawing Sheets

DUST-TOLERANT ELECTRICAL CONNECTOR

CROSS-REFERENCE TO RELATED APPLICATIONS

This application claims priority to U.S. Provisional Patent Application No. 61/158,933, filed Mar. 10, 2009, the contents of which is herein incorporated by reference.

STATEMENT REGARDING FEDERALLY SPONSORED RESEARCH OR DEVELOPMENT

The subject matter herein was developed in part under a research contract provided by the U.S. Government under Contract No. NNX08CB609 provided by the National Aeronautics and Space Administration (NASA) Glenn Research Center. The U.S. Government retains certain rights in the invention.

FIELD OF THE INVENTION

The present invention relates to a device for making an electrical connection, and more particularly, to a reusable device for making an electrical connection in the presence of contaminants, such as dust.

BACKGROUND OF THE INVENTION

Dust, and more particularly Lunar dust, has been identified as a significant and present challenge in future exploration missions. In addition to posing contamination and health risks for human explorers, the interlocking, angular nature of Lunar dust and its broad grain size distribution make it particularly detrimental to mechanisms with which it may come into contact.

All Apollo Lunar missions experienced some degree of equipment failure due to dust, and it appears that dust accumulation on exposed material is unavoidable and difficult to reverse. Future exploration missions will ultimately be far longer and include far more extensive surface activities than in Apollo, thus problems with dust accumulation will likely be more prominent.

The connection mechanisms used in Lunar missions are typically scaled versions of terrestrial connections and are not designed with Lunar dust in mind. Although current connector designs may work at a high level, attributes of the connector designs, such as alignment features, clearances, screw threads, locking mechanisms, and the like, need to be analyzed within the context of Lunar dust to prolong the life of such connections in the harsh Lunar environment.

A new generation of interconnections are needed to accommodate the order of magnitude increase in Lunar surface activity expected by exploration surface systems and equipment in future Lunar missions.

SUMMARY OF THE INVENTION

According to one embodiment, a connector assembly includes releasably mateable plug units and receptacle units. The receptacle unit has a rear end and a front end. At least one socket is enclosed within the receptacle unit. At least one permeable membrane is disposed in the front end of the receptacle unit and is aligned with the socket. The plug unit has a front end, a rear end, and a longitudinal bore extending at partially therethrough. A body is slidably mounted in the bore of the plug unit. At least one pin extends from the front end of the body. At least one permeable membrane is disposed in the front end of the plug unit and is aligned with the pin. The plug unit is biased toward a first de-mate position in which the body is extended rearwardly such that the pin is enclosed with the plug unit. The plug unit is slidable to a second mate position in which the body is compressed forwardly such that the pin projects through the permeable membranes of the plug unit and the receptacle unit and makes an electrical connection with the socket.

In at least one embodiment, a spring biases the body toward the de-mate position.

In at least one embodiment, a passive cam biases the body toward the de-mate position.

In at least one embodiment, an extendible cover encloses the rear end of the body protruding from the housing.

In at least one embodiment, the permeable membranes extend beyond the front ends of the plug unit and receptacle unit.

In at least one embodiment, when the plug unit and receptacle unit are pressed together, the permeable membranes of the plug unit and receptacle unit are compressed to form a seal.

In at least one embodiment, the permeable membranes of the plug unit and receptacle unit define apertures through which the pins are pushed during mating.

In at least one embodiment, the permeable membranes act to re-seal the apertures due to the shape memory of the membrane material.

In at least one embodiment, springs are disposed around the permeable membranes of the plug unit and receptacle unit to bias the apertures closed.

In at least one embodiment, the permeable membranes of the plug unit and receptacle unit maintain a seal with the pin as the pin is advanced through the permeable membrane.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

The description hereinafter describes exemplary embodiments of an electrical connector. The electrical connector is a repeatable device interconnection that tolerates the presence of significant quantities of contaminants, such as dust, while retaining sufficient electrical performance characteristics and prevents or retards contaminant accumulation. The electrical connector provides sufficient mechanical integrity when connected for use in load bearing and torque transmitting applications.

Figure 1:
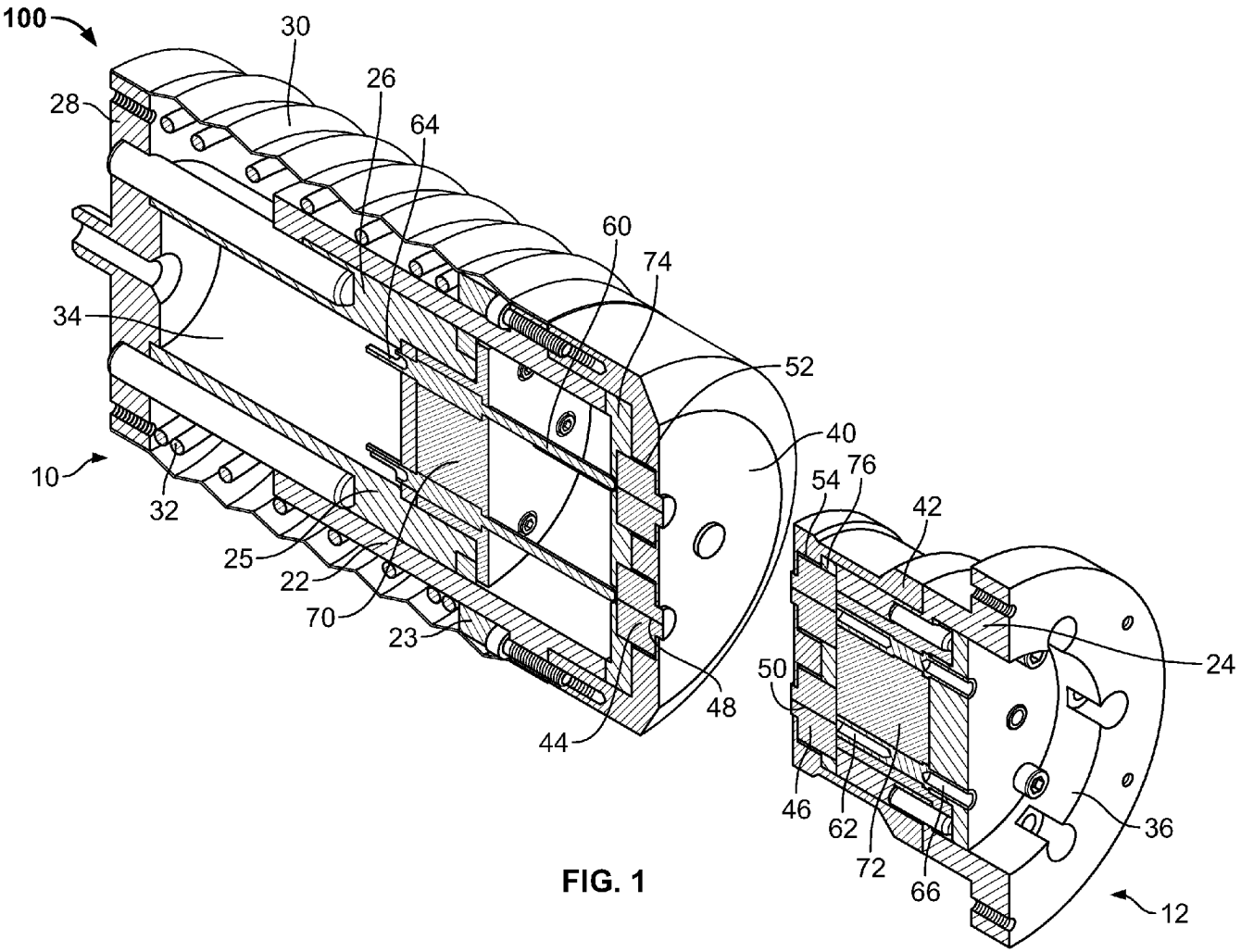
FIG. 1 is a sectional perspective view of an electrical connector according to an embodiment of the present invention.
Figure 2:
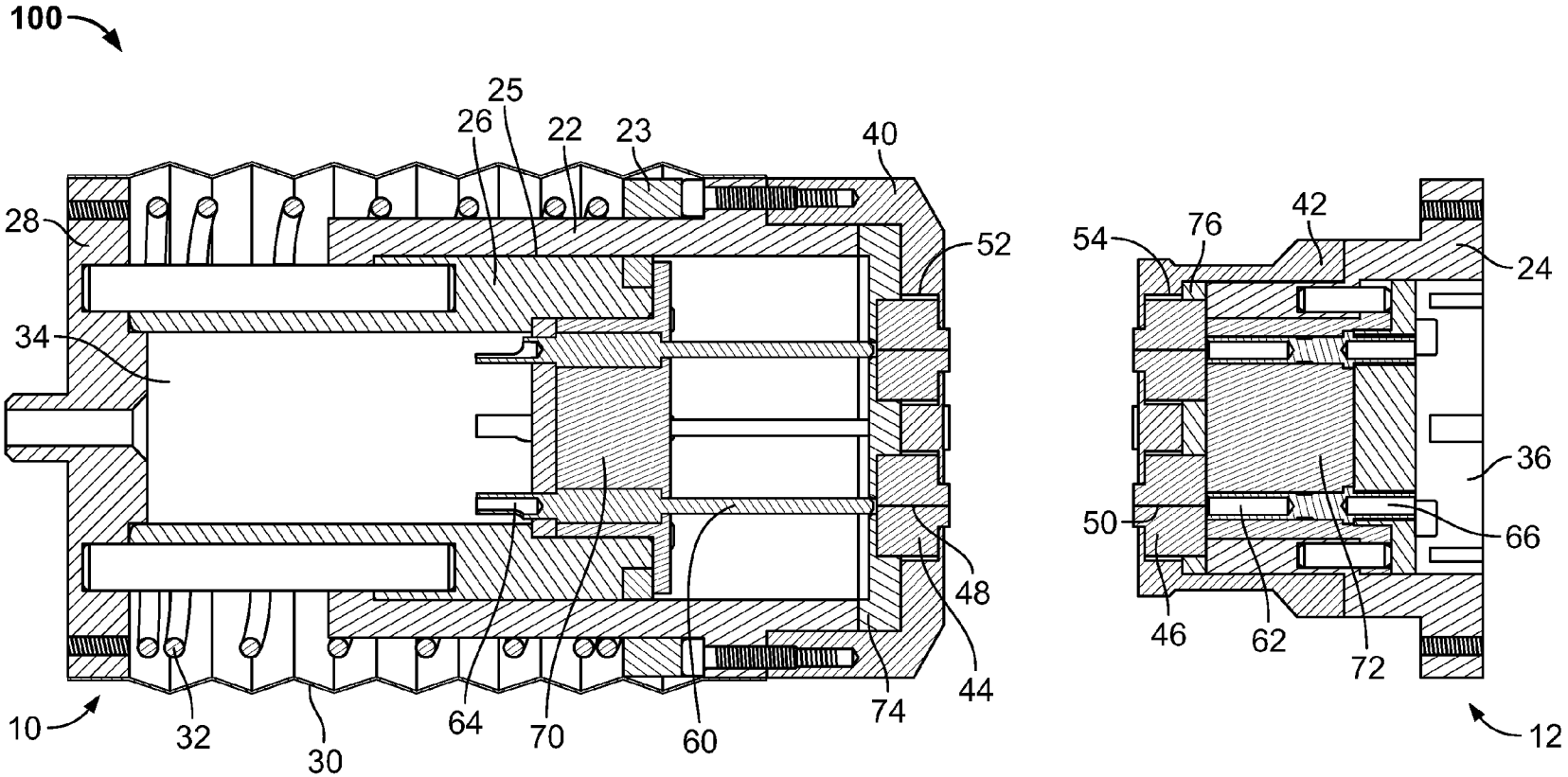
FIG. 2 is a sectional view illustrating the plug and receptacle units of the electrical connector juxtaposed in a demated arrangement prior to mating.

FIGS. 1-2 illustrate an electrical connector 100 according to an exemplary embodiment in a de-mated position.

Referring to FIGS. 1-2, the electrical connector 100 comprises a plug unit 10 and a receptacle unit 12 which are designed for releasable mating engagement to form a device interconnection. The plug unit 10 has a rear end configured for connection to an end of an electrical cable and a front end configured for releasable engagement with the receptacle unit 12. The receptacle unit 12 has a rear end configured for connection to an electrical cable and a front end configured for releasable engagement with the plug unit 10. In other embodiments, the rear ends of either of the plug unit 10 or receptacle unit 12 may be configured for direct connection to an electrical device.

The plug unit 10 comprises a housing 22, a body 26, and a retaining back plate 28. The front end of the body 26 is slidably seated within a central through bore 34 extending longitudinally in the housing 22. The retaining back plate 28 is secured to or formed integrally with the rear end of the body 26. A spring 32 is disposed between the retaining back plate 28 and a shoulder 23 on the housing 22. The spring 32 axially preloads the body 26 toward the retaining back plate 28 such that the plug unit 10 is biased to an extended de-mate position. Other embodiments may employ different methods of biasing the body 26 to the de-mate position, such as the use of a passive cam. The spring force or cam geometry can be chosen based on desired mate force, as well as required force to de-mate. An extendible cover 30 is used to seal the spring 32 and internal sliding interface 25 between housing 22 and the body 26 from contaminant particles.

A pin mount 70 is attached to the front end of the body 26. A plurality of pins 60 are housed in the pin mount 70 and extend forwardly from the front face of the pin mount 70. The pins 60 include pin contacts 64 that extend rearwardly from the rear face of the pin mount 70. The pin contacts 64 are adapted to receive terminals from an electrical cable and may be secured to the terminals by one of the many methods known in the art.

The pins 60 are comprised of an electrical conductive material. For example, the pins 60 may comprise gold, copper, aluminum, or the like. Preferably, the pins 60 are gold-plated with a nickel barrier layer to increase conductivity, solderability, and decrease resistance over the interface. The pin mount 70 is comprised of insulating material to isolate the pins 60 from their surroundings. For example, the pin mount 70 may be comprised of an insulating polymer based material, such as Vespel®, manufactured by DuPont™, which is often used in the hostile and extreme environmental conditions encountered found in space exploration.

A front cover 40 is secured over or formed integrally with the front end of the housing 22 to seal the pins 60 and the front face of the pin mount 70 from contaminant particles. Permeable membranes 44 are disposed in the front cover 40 in positions aligned with each of the pins 60. The permeable membranes 44 define apertures 48 through which the pins 60 are pushed during mating. For example, the permeable membranes 44 may be comprised of a variety of felts, foams, elastomers, polymers, or the like. In one example embodiment, the material used to form the permeable membranes may act to re-seal the apertures due to the shape memory of the material. In another example embodiment, springs 52 may be provided around the perimeter of the permeable membranes 44 to aid in closure of the apertures 48 when de-mated. The closed permeable membranes 44 prevent contaminant particles from entering the plug unit 10 and coating the pins 60 when the electrical connector 100 is de-mated.

A pin guide 74 is mounted on the inside of the front cover 40 to support the permeable membranes 44 and to guide the pins 60 through the apertures 48 of the permeable membranes 44. The pin guide 74 is comprised of insulating material. For example, the pin guide 74 may be comprised of an insulating polymer based material, such as Vespel®.

The receptacle unit 12 comprises a housing 24 having a central through bore 36 extending longitudinally therein. A socket mount 72 is fixed inside the central bore 36 near the front end of the housing 24. A plurality of sockets 62 are housed in the socket mount 72 and are adapted to receive the pins 60 from the plug unit 10 at the front face of the socket mount 72. The sockets 62 include socket contacts 66 that extend rearwardly from the rear face of the socket mount 72. The socket contacts 66 are adapted to receive terminals from an electrical cable and may be secured to the terminals by one of the many methods known in the art.

The sockets 62 are comprised of an electrical conductive material. For example, the sockets 62 may comprise gold, copper, aluminum, or the like. Preferably, the sockets 62 are gold-plated with a nickel barrier layer to increase conductivity, solderability, and decrease resistance over the interface. The socket mount 72 is comprised of insulating material to isolate the sockets 62 from their surroundings. For example, the socket mount 72 may be comprised of an insulating polymer based material, such as Vespel®.

A front cover 42 is secured over or formed integrally with the front end of the housing 24 to seal the sockets 62 and the front face of the socket mount 72 from contaminant particles. Permeable membranes 46 are disposed in the front cover 42 in positions aligned with each of the sockets 62. The permeable membranes 46 define apertures 50 through which the pins 60 from the plug unit are inserted during mating. For example, the permeable membranes 46 may be comprises a variety of felts, foams, elastomers, polymers, or the like. Springs 54 may be provided around the perimeter of the permeable membranes 46 to aid in closure of the apertures 50 when de-mated. The closed permeable membranes 46 prevent contaminant particles from entering the receptacle unit 12 and coating the sockets 62 when the electrical connector 100 is de-mated.

A socket guide 76 is mounted on the inside of the front cover 42 to support the permeable membranes 46 and to guide the pins 60 through to the sockets 62 after passing through the permeable membranes 46. The pin guide 74 is comprised of insulating material. For example, the pin guide 74 may be comprised of an insulating polymer based material, such as Vespel®.

Figure 3:
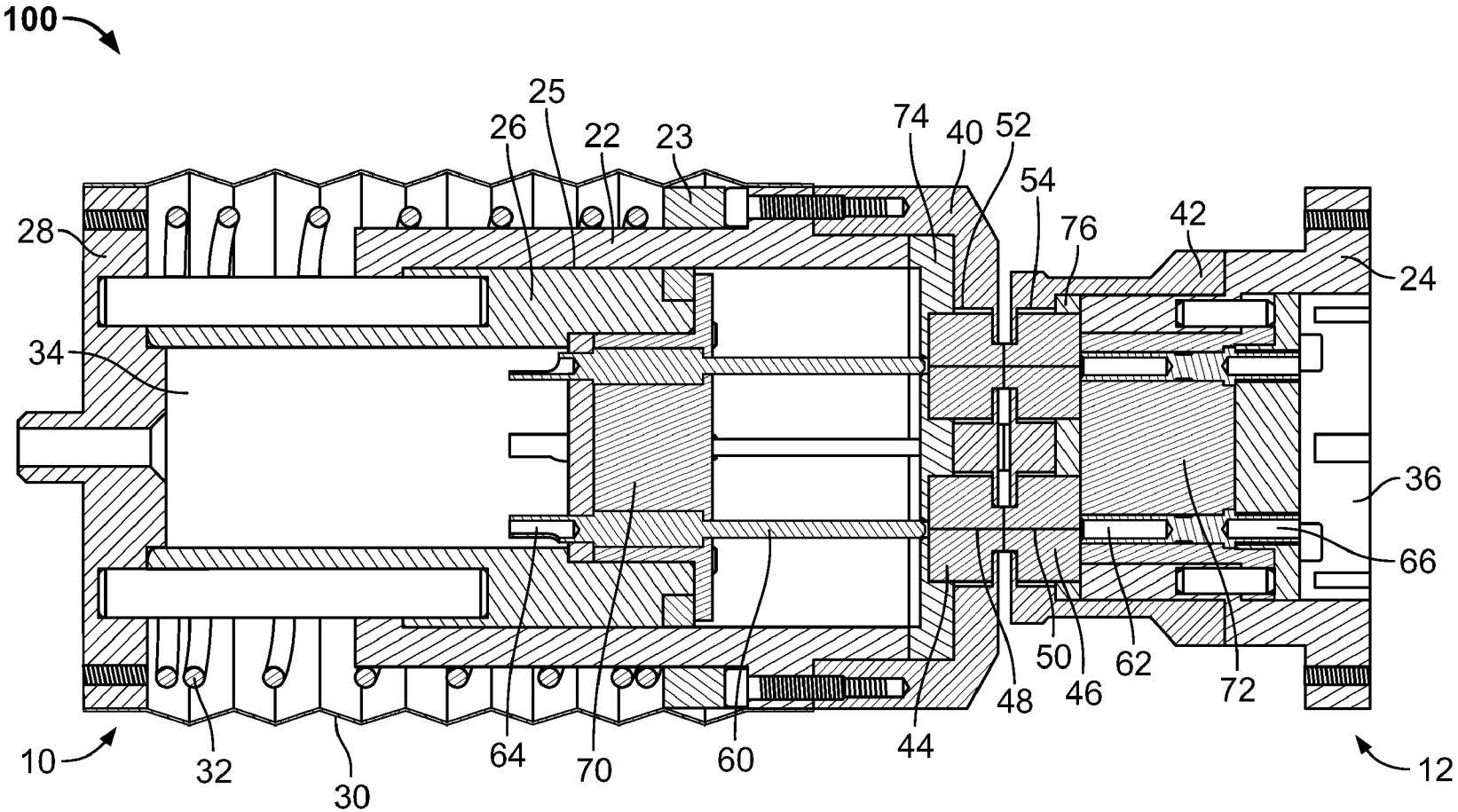
FIG. 3 is a sectional view illustrating the plug and receptacle units of the electrical connector in an abutting preloaded arrangement prior to mating.
Figure 4:
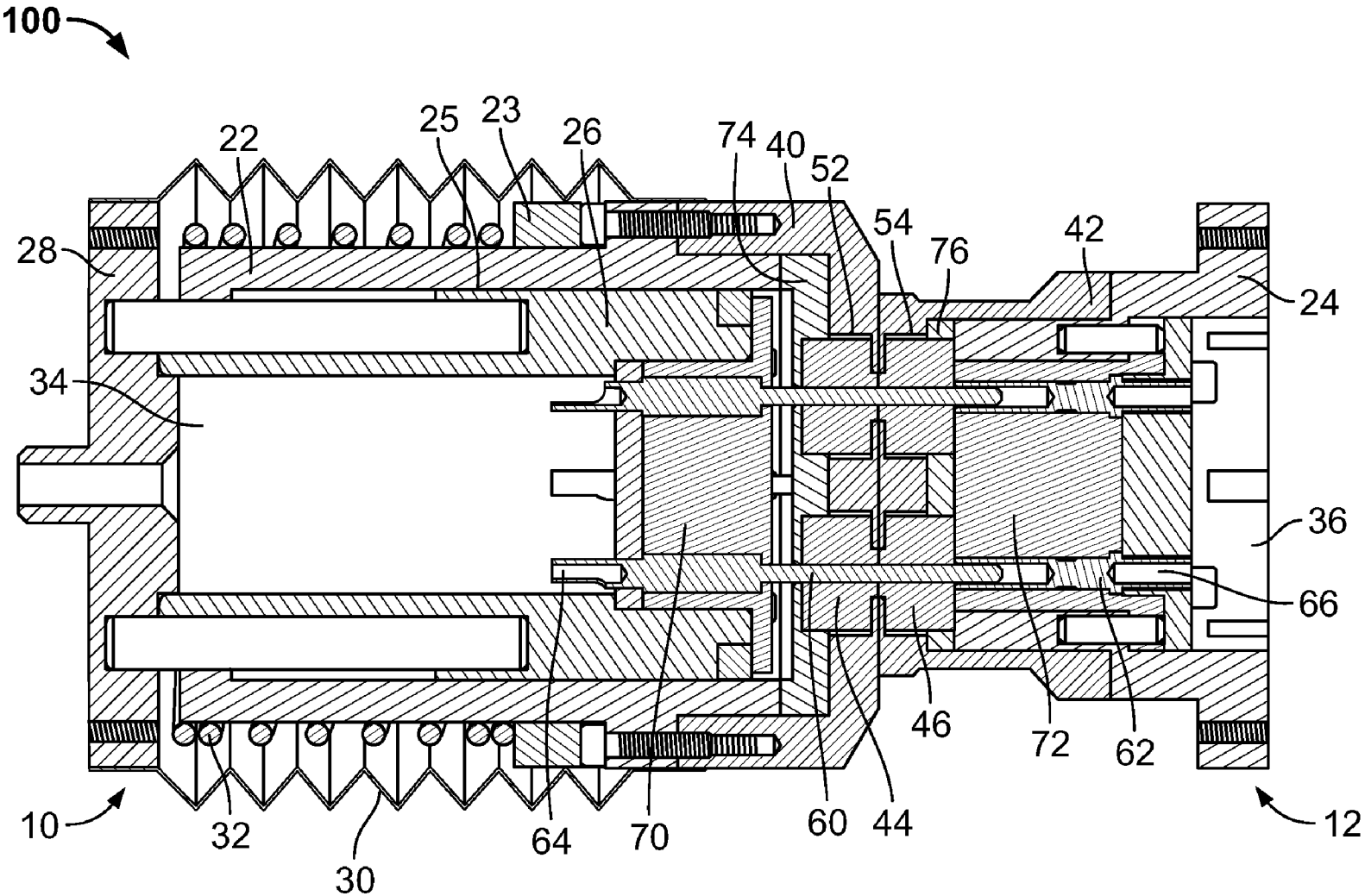
FIG. 4 is a sectional view illustrating the plug and receptacle units of the electrical connector in a mated arrangement creating an electrical connection.

FIGS. 3 and 4 illustrate the mating process of the electrical connector 100 to form a device interconnection.

Referring to FIG. 3, the electrical connector 100 is shown in an abutting preloaded arrangement. The plug unit 10 and receptacle unit 12 are positioned such that the front covers 40, 42 are in a face-to-face engagement and the pins 60 are in alignment with corresponding sockets 62. The plug unit 10 remains preloaded in the extended de-mate position until enough compressive force is provided to overcome the preload spring force of the spring 32 in plug unit 10.

The abutting front covers 40, 42 form a hard-stop interface. The permeable membranes 44, 46 extend past front covers 40, 42 and are pressed together in a compressive preload. This creates a seal at the contact zone between the permeable membranes 44, 46 that traps contaminant particles that may be coating the connecting surfaces of the permeable membranes 44, 46 in the contact zone and prevents contaminant particles that may be coating the front covers 40, 42 from entering the contact zone.

Referring to FIG. 4, the electrical connector is shown in a mated arrangement. When enough compressive force is provided to overcome the preload spring force of the spring 32 in plug unit 10, the body 26 is slid forwardly in the central through bore 34 of the housing 22 towards the front cover 40 until the plug unit 10 is compressed into a mate position. As the plug unit 10 is compressed, the pins 60 are advanced forward through the apertures 48, 50 in the permeable membranes 44, 46 of the plug unit 10 and the receptacle unit 12, respectively.

The apertures 48, 50 in the permeable membranes 44, 46 are forced to expand as the pins 60 are passed through. However, the permeable membranes 44, 46 maintain contact with the pins 60 to create a tight seal that prevents particles from entering either the plug unit 10 or receptacle unit 12. The contact between the pins 60 and the permeable membranes 44, 46 cleans the pins 60 during the mating process. Any dust particles that are trapped in the contact zone between the permeable membranes 44, 46 are forced out of the way by the advancing pins 60.

After the pins 60 are pushed through both sets of membranes 44, 46, the pins 60 are received in the sockets 62 of the receptacle unit 12 to create an electrical connection. Any standard coupling device may be employed to maintain the plug unit 10 and receptacle unit 12 in their connected condition as known in the art.

The interconnected electrical connector 100 provides sealed passages between the pins 60 of the plug unit 10 and sockets 62 of the receptacle unit 12 to create an electrical connection that is protected from contaminant particles.

It is intended that the electrical connector may provide for future integration with electrical, fluid, and other utility transfer applications.

Near-term applications of such a connector include the utility and electrical connections that will be used on the next-generation spacesuits, as well as in-situ resource utilization (ISRU) activities and other lunar surface systems. This technology is also applicable to defense and industrial applications involving dusty environments where high reliability and low maintenance is important.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A connector assembly comprising:

a receptacle unit having a rear end and a front end; at least one socket enclosed within the receptacle unit;

at least one permeable membrane disposed in the front end of the receptacle unit aligned with the at least one socket;

a plug unit having a front end and, a rear end, and at least one longitudinal bore extending at partially therethrough, the front end being releasably mateable with the front end of the receptacle unit;

a body having a front end and a rear end, the front end of the body being slidably mounted in the bore of the plug unit;

at least one pin extending from the front end of the body;

at least one permeable membrane disposed in the front end of the plug unit aligned with the pin;

the plug unit being biased toward a first de-mate position in which the body is extended rearwardly such that the pin is enclosed with the plug unit and being slidable to a second mate position in which the body is compressed forwardly such that the pin projects through the permeable membranes of the plug unit and the receptacle unit and makes an electrical connection with the socket;

wherein the permeable membranes of the plug unit and receptacle unit maintain a seal with the pin as the pin is advanced through the permeable membrane.

2. The connector assembly of claim 1, further comprising: a spring biasing the body toward the de-mate position.

3. The connector assembly of claim 1, further comprising: an extendible cover enclosing the rear end of the body protruding from the housing.

4. The connector assembly of claim 1, wherein the permeable membranes extend beyond the front ends of the plug unit and receptacle unit.

5. The connector of claim 1, wherein when the plug unit and receptacle unit are pressed together, the permeable membranes of the plug unit and receptacle unit are compressed to form a seal.

6. The connector assembly of claim 1, wherein the permeable membranes of the plug unit and receptacle unit define apertures through which the pins are pushed during mating.

7. The connector assembly of claim 6, wherein the permeable membranes act to re-seal the apertures due to the shape memory of the membrane material.

8. The connector assembly of claim 6, further comprising: springs disposed around the permeable membranes of the plug unit and receptacle unit to bias the apertures closed.

* * * * *